United States Patent [19]

Straubel et al.

[11] 4,353,340

[45] Oct. 12, 1982

[54] FUEL INJECTION PUMP FOR INTERNAL COMBUSTION ENGINES

[75] Inventors: Max Straubel, Stuttgart; Karl Konrath, Ludwigsburg; Gerhard Brink, Stuttgart, all of Fed. Rep. of Germany

[73] Assignee: Robert Bosch GmbH, Stuttgart, Fed. Rep. of Germany

[21] Appl. No.: 188,788

[22] Filed: Sep. 19, 1980

[30] Foreign Application Priority Data

Oct. 20, 1979 [DE] Fed. Rep. of Germany ..... 2942493

[51] Int. Cl.[3] ..... F02D 31/00

[52] U.S. Cl. ..... 123/365; 123/369; 123/367

[58] Field of Search ..... 123/365, 367, 369, 339

[56] References Cited

U.S. PATENT DOCUMENTS

| | | | |
|---|---|---|---|
| 2,708,921 | 5/1955 | Links | 123/367 |
| 3,003,489 | 10/1961 | Scibbe et al. | 123/365 |
| 3,033,186 | 5/1962 | Staege et al. | 123/365 |
| 3,871,344 | 3/1975 | Pigeroulet | 123/367 |
| 4,254,753 | 3/1981 | Ritter et al. | 123/365 |

FOREIGN PATENT DOCUMENTS

| | | | |
|---|---|---|---|
| 755314 | 8/1956 | United Kingdom | 123/365 |
| 1328805 | 9/1973 | United Kingdom | 123/369 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump is disclosed in which the minimum injection quantity or idling rpm is determined by an arbitrarily adjustable stop. This stop is adjusted via a heatable bimetallic spiral, which acts counter to a spiral spring for the purpose of force compensation.

3 Claims, 2 Drawing Figures

FUEL INJECTION PUMP FOR INTERNAL COMBUSTION ENGINES

BACKGROUND OF THE INVENTION

The invention relates to a fuel injection pump having an adjusting lever for injection quantity and an adjustable stop for setting idle rpm. In a known fuel injection pump of this kind, an adjustable screw which can be locked by a nut acts as a stop for the minimum injection quantity, that is, a quantity such as is desired for idling. The provision of the larger injection quantities necessary during warmup is then effected by specialized means in the governor, which either does not permit an arbitrary variation of this minimum quantity or permits such a variation to be made only with substantial difficulty.

OBJECT AND SUMMARY OF THE INVENTION

It is an object of the invention to provide a fuel injection pump having the advantage over the prior art that the minimum-quantity adjustment is effected simply, inexpensively and in an arbitrarily controllable manner.

It is another object of the invention to provide a stop wherein a differently shaped face may be selected for different internal combustion engines and can be installed on a mass-produced pump in a modular manner.

It is a further object of the invention to provide an adjustment means whose installation is extremely simple and, as installed, is wear-resistant. This results because the forces are exerted in the axial direction so that no tilting moment results, and thus there is extremely little wear because the shaped surface area is so large.

It is still further object of the invention to provide that basic initial adjustment of the apparatus may be undertaken without thereby influencing the established governor characteristics of the pump governor.

It is yet another object of the invention that the minimum fuel injection quantity be determined by a stop which is variable in accordance with engine characteristics or with the characteristics of the environment within which the engine operates.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
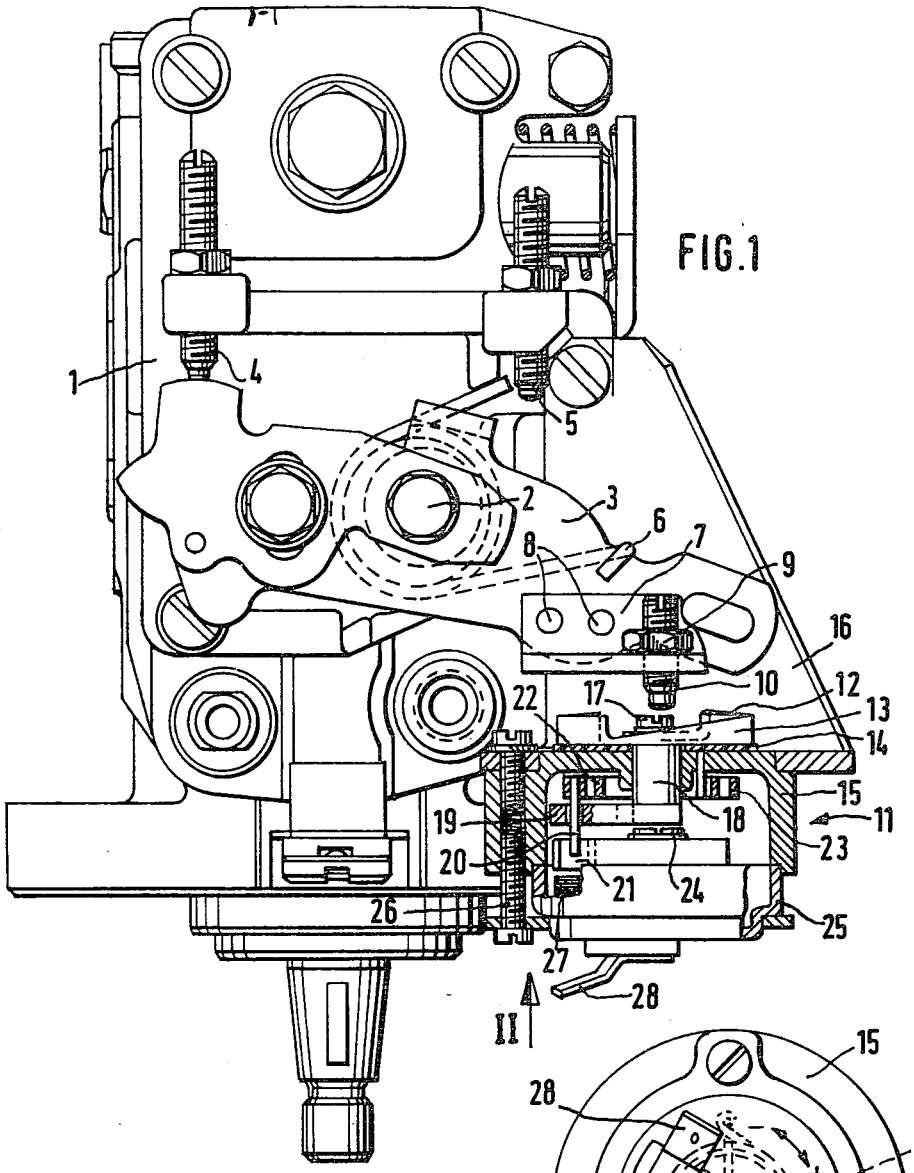
FIG. 1 shows an injection pump having the stop apparatus shown in sectional form.

An adjusting lever 3 is disposed on a shaft 2 in a fuel injection pump 1. The rotary position of this adjusting lever 3 determines the fuel injection quantity and this quantity can be arbitrarily adjusted by the driver of the vehicle in which the internal combustion engine is provided and so equipped. An electric governor can be controlled by means of the shaft 2 or, as in the case of a mechanical governor, for instance, the initial tension of the governor spring can be varied. The rotary position of the adjusting lever 3 is defined by stops, with a first stop 4 in principle defining the minimum quantity and a second stop 5 defining the maximum quantity. A restoring spring 6 biases the lever 3 toward the position of stop 4 to provide the minimum supply quantity, which corresponds normally to that quantity which is desirable at idling.

Figure 2:
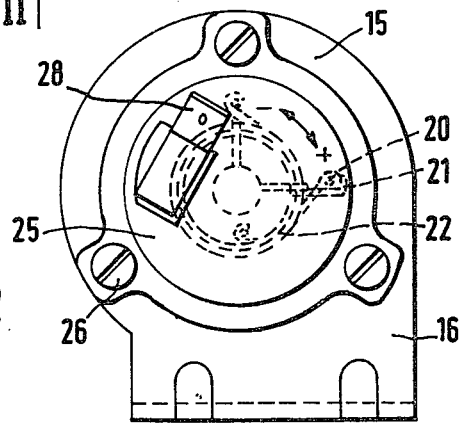
FIG. 2 is a view of the stop apparatus along the direction indicated by the arrow II, but rotated by 45° and showing schematically the bimetallic spiral element not otherwise visible.

To provide a minimum fuel quantity which can be varied by a stop means in accordance with engine operating parameters, an angled tongue 7 is provided on the lever 3 by securing elements 8, and a stop screw 10 which can be locked in position by a nut 9 extends therethrough. This stop screw 10 is arranged to cooperate with a stop apparatus 11, which is provided with a cam face 12 as a stop for the stop screw 10 on one extremity thereof and lying in opposed spaced relation to the stop screw 10. This cam face 12 is rotatable in a plane extending perpendicular to the pivotal plane of the lever 3. As best shown in FIG. 1, this cam face 12 is shown rotated by 45° for the sake of better visibility. In its actual installed position, the screw 10 would be abutting the cam face 12. The cam face 12 is provided as a surface of a collar cam disc element 13, which is mounted via a plastic disc 14 on the end face of a sleeve 15, which in turn is secured on the injection pump 1 by a mounting bracket 16. The collar element 13 is secured by a screw 17 on a shaft 18, which is supported in the end wall of the sleeve 15 and has a rotation lever 19. This rotation lever 19 is coupled via a pin 20 at one extremity thereof with a bimetallic spiral 21 and at the other extremity with a spiral spring 22. The spiral spring 22 is firmly connected at a zone 23 via its inner end with the sleeve 15. The inner end of the bimetallic spiral 21 is also firmly connected with the sleeve 15, being secured via a screw 24 to a cap 25 of the sleeve 15, the cap 25 being secured via screws 26 to the sleeve 15. A heating element 27 is disposed in this cap 25 and can heat the bimetallic spiral 21 through one surface and this heating element is provided with an electrical connection 28. FIG. 2 is a view of the stop apparatus 11 seen from the end face in the direction indicated by arrow II. Because the spiral elements disposed in the sleeve 15 are not normally visible from the outside, these elements are indicated by broken lines for the sake of clarity in explaining the function of the stop apparatus 11. The bimetallic spiral 21 and the spiral spring 22 engage the pin 20, which is firmly connected with the lever 19, from opposite directions; that is, spiral spring 22 engages the pin 20 in the manner of a right-handed screw, while the bimetallic spiral 21 engages the pin 20 in the manner of a left-handed screw, each direction being as seen in the drawing. In FIG. 2, two positions are shown for the pin 20. The angular difference between these positions results in a corresponding difference in height of the stop apparatus 11; this movement is translated to the adjusting lever 3 of the injection pump 1, so that the lever 3 moves a corresponding angular difference. To provide the desired stop value, the bimetallic spiral 21 can be heated to a greater or lesser extent, so that the pin 20 can assume any desired position between the two illustrated positions, especially when the ambient temperature is very low during engine starting.

Alternatively, the invention comprehends influencing the position of the pin 20 by providing the cam disc element 13 with various inclinations on the cam face 12. Because the fuel quantity adjustment is effected by means of heating, the occasions upon which heating occurs may be selected quite freely, for instance, during warmup of the engine, upon a change in ambient air pressure or during the operation of an air conditioner, it may be desirable for such heating to be performed. Depending upon the requirements placed upon the engine, the idling rpm thus can be increased or reduced, depending upon the particular inclination abutting the stop screw 10 provided by a change in the direction imparted to the cam disc 13.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines, including a housing and having an arbitrarily actuatable lever for adjusting injection quantity moving through a lever path and an adjustable stop associated with said lever for determining the minimum injection quantity characterized in that said stop includes a rotatable cam disc displayed perpendicularly relative to the plane of said lever path and a bimetallic spiral for rotational adjustment of said cam disc relative to said stop, wherein said stop further includes a spiral spring which serves to return said cam disc to a restoring position.

2. A fuel injection pump for internal combustion engines, including a housing and having an arbitrarily actuatable lever for adjusting injection quantity moving through a lever path and an adjustable stop associated with said lever for determining the minimum injection quantity characterized in that said stop includes a rotatable cam disc disposed perpendicularly relative to the plane of said lever path and a bimetallic spiral for rotational adjustment of said cam disc relative to said stop, wherein said housing further includes means to house said bimetallic spiral which engages a rotational lever carried by a shaft arranged to cooperate with said cam disc, wherein the fuel injection pump also includes a spiral spring disposed in said means to house said bimetallic spring, wherein said spiral spring includes a free end which engages the rotation lever.

3. A fuel injection pump for internal combustion engines, including a housing and having an arbitrarily actuatable lever for adjusting injection quantity moving through a lever path and an adjustable stop associated with said lever for determining the minimum injection quantity characterized in that said stop includes a rotatable cam disc disposed perpendicularly relative to the plane of said lever path and a bimetallic spiral for rotational adjustment of said cam disc relative to said stop, wherein said housing further includes means to house said bimetallic spiral which engages a rotation lever carried by a shaft arranged to cooperate with said cam disc, and wherein said cam disc is spaced from said means to house said bimetallic spiral and a plastic disc is disposed therebetween.

* * * * *